US008789547B1

(12) United States Patent
Reda

(10) Patent No.: US 8,789,547 B1
(45) Date of Patent: Jul. 29, 2014

(54) GLIDE PAD FOR WALKER

(71) Applicant: Yunga Tart LLC, Edina, MN (US)

(72) Inventor: Kareem Reda, Edina, MN (US)

(73) Assignee: Yunga Tart LLC, Edina, MN (US)

( * ) Notice: Subject to any disclaimer, the term of this patent is extended or adjusted under 35 U.S.C. 154(b) by 0 days.

(21) Appl. No.: 13/786,140

(22) Filed: Mar. 5, 2013

(51) Int. Cl.
*A45B 9/04* (2006.01)
*A61H 3/00* (2006.01)

(52) U.S. Cl.
CPC ..... *A61H 3/00* (2013.01)
USPC ..... 135/77

(58) Field of Classification Search
USPC ..... 135/77; 248/188.8, 188.9; 16/42 R, 42 T, 16/43
See application file for complete search history.

(56) References Cited

U.S. PATENT DOCUMENTS 2,100,570 A * 11/1937 Saleh ..... 411/24
2,173,950 A * 9/1939 Parkhill ..... 16/21
2,434,863 A * 1/1948 Parkhill ..... 16/39
2,955,504 A * 10/1960 Lovrinch et al. ..... 411/51
4,805,260 A * 2/1989 Tooth ..... 16/37
5,224,506 A * 7/1993 Allen et al. ..... 135/67
5,782,256 A * 7/1998 Bradley ..... 135/77
6,308,590 B1 * 10/2001 Berto ..... 74/551.8
2007/0169308 A1 * 7/2007 Chiu ..... 16/42 R

* cited by examiner

*Primary Examiner* — Noah Chandler Hawk
(74) *Attorney, Agent, or Firm* — Westman, Champlin & Koehler, P.A.; Z. Peter Sawicki; A. Prose

(57) ABSTRACT

A glider for attachment to a hollow lower portion of a walker leg, comprising a ground engaging base; a first pair of stem portions extending from and attached to the base; a top portion comprising a frustoconical main body to engage the first pair of stems and having a shape so that an outer surface of the main body engages an inner surface of a stem; a second pair of stem portions extending from and attached to the top portion; and a mechanism for drawing the main body in between the pair of stem portions to flex the stems outwardly. Securing the glide comprises inserting the attachment and a fastener into the walker leg; the fastener extending through a base aperture into a top portion aperture and fastening the fastener to engage each stem portion causing the stems to extend outwardly and engage an inner surface of the hollow walker leg.

9 Claims, 5 Drawing Sheets

GLIDE PAD FOR WALKER

FIELD OF THE INVENTION

The present invention relates to an attachment adaptable to standard walkers which, when attached, will aid in walker mobility by supporting the walker feet tips during movement of the walker across a surface and allow the user to slide the walker rather than lift the walker off the ground.

A mobility walker is a device that offers support and stability for someone who needs help while walking. Mobility walkers are sometimes simply called walkers or walker frames. Walkers are usually light weight metal frames with four legs with the frame extending upwardly so that a user can grab hold of the frame and move the frame while walking, relying on the frame to maintain balance while moving or while simply standing still. The walker extends vertically up to approximately waist high to the user.

Although all four legs of the walker may have wheels, it is common that only the front two legs of the walker have wheels, and the back two legs of the walker not having wheels. With the back two legs not having the ability to roll easily, the walker provides a more steady support.

While moving forward on the walker, the back two legs move along the ground, frictionally engaging the ground. To aid in the back two legs moving more easily on the ground, but not too easily, various types of skid members have been developed. The skid members (sometimes referred to as gliders) are attached to the bottom of the back two legs and permit sliding over various types of surfaces. Examples of such skid members are described and/or shown in U.S. design patents D442,123 and D433,354 and U.S. Pat. Nos. 5,224,506, 7,743,780 and 7,882,848. Another example of a tip useful for a walker or a crutch is described in U.S. Pat. No. 7,748,396.

Since the skid members frictionally engage the ground, unlike wheels, the skid members will wear out, therefore the gliders have to be replaced occasionally. The previously mentioned gliders, tips and/or other attachments to the bottom of the walker legs have shortcomings relating to the method of attachment. The instant invention provides a solution to such problems.

SUMMARY OF THE INVENTION

This disclosure relates to an attachment for a walker leg, the walker leg having a hollow lower portion and the attachment comprising a ground engaging base; a first pair of stem portions spaced from each other and extending from and being attached to the base; a top portion comprising a frustoconical main body to engage the first pair of stems and having a shape so that an outer surface of the main body engages an inner surface of a stem so the outer surface of the stem engages the inner surface of the hollow lower portion of the leg; a second pair of stem portions spaced from each other and extending from and being attached to the top portion; and a mechanism for drawing the main body in between the pair of stem portions to flex the stems outwardly.

This disclosure also relates to a method of securing an attachment to a walker leg, the walker leg having a hollow lower portion, the method comprising connecting a pair of stem portions spaced from each other and extending from a ground engaging base with a second pair of stem portions spaced from each other and extending from a top portion to form an insert; placing the insert into the hollow lower portion of the walker leg; inserting a fastener through an aperture in the ground engaging base and extending the fastener into an aperture in the top portion to thereby hold the insert in connection; and fastening the fastener to thereby engage the top portion with the first pair of stem portions and to thereby engage the base with the second pair of stem portions causing the pairs of stems to extend outwardly to engage with an inner surface of the hollow walker leg.

DETAILED DESCRIPTION OF THE INVENTION

This disclosure describes a glider that attaches to the rear two legs of a walker that typically has wheels on the front two legs. The glider can be used with any walker having a hollow leg, or any device with a hollow leg used to assist a user in walking. The glider is secured in a stable way, ensuring the glider does not dislodge from the walker leg during use.

Figure 1:
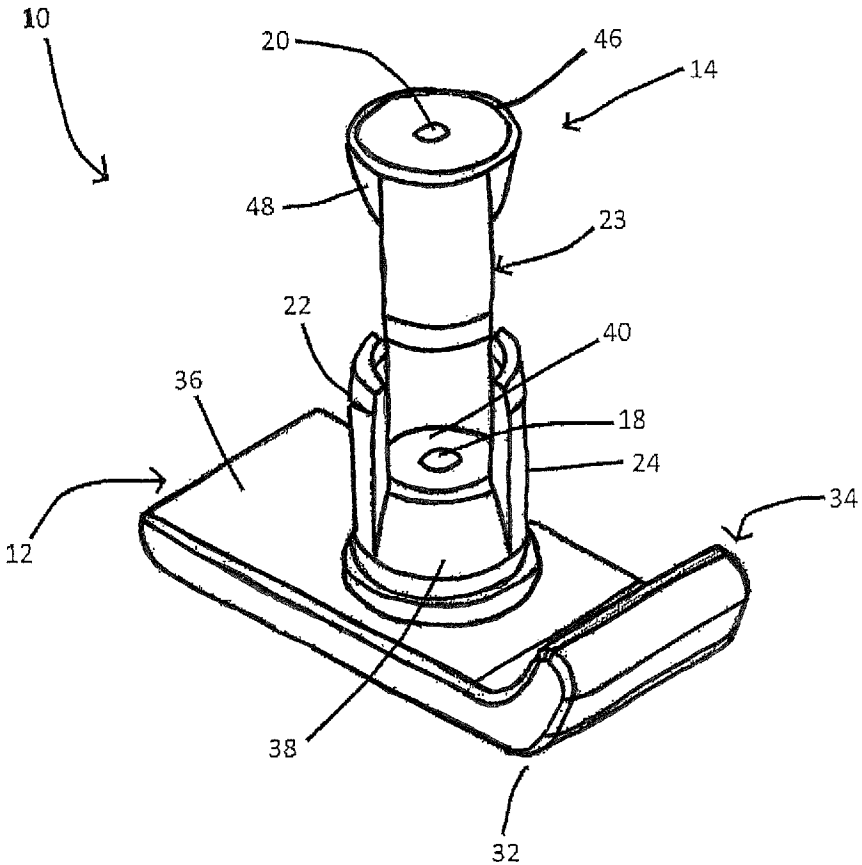
FIG. 1 is a perspective view of a glide pad for a walker.

The glider is generally illustrated in FIG. 1 at 10. The glider comprises a glider base 12 and a glider top portion 14 wherein the base 12 and the top portion 14 are connected by a fastener 16 extending through an aperture 18 in the base 12 to connect with an aperture 20 in the top portion 14. The base 12 makes contact with the ground surface. The base 12 has two stems 22 and 24 that when positioned with the top portion 14 comprises an insert 26 which is inserted into a hollow leg of a walker 28. Upon inserting the fastener 16, the top portion 14 engages with the stems 22 and 24 of the base 12 to frictionally engage the stems 22 and 24 with the inside surface of the hollow walker leg 28. The base 12 engages with stems 23 and 25 of the top portion 14 to frictionally engage the stems 23 and 25 with a second inside surface of the hollow walker leg, thereby securing the base 12 to the walker.

Figure 2:
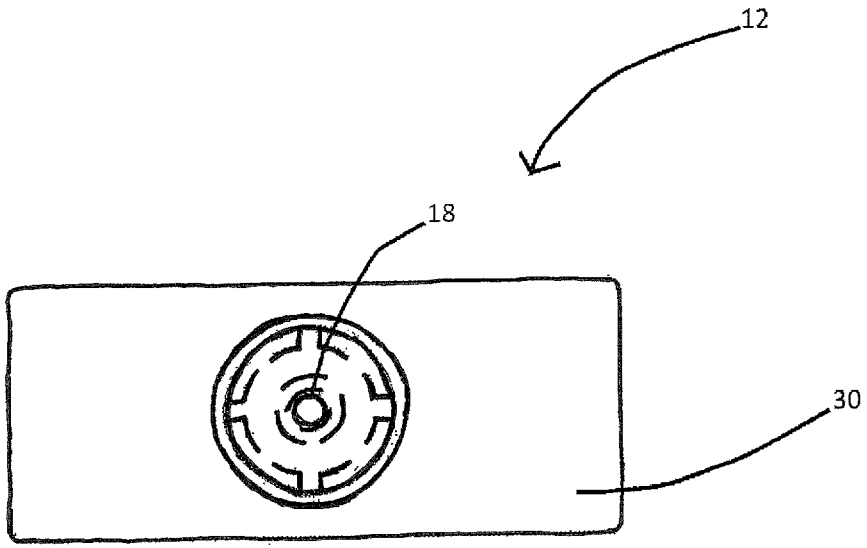
FIG. 2 is a bottom view of the glide pad for a walker.
Figure 3:
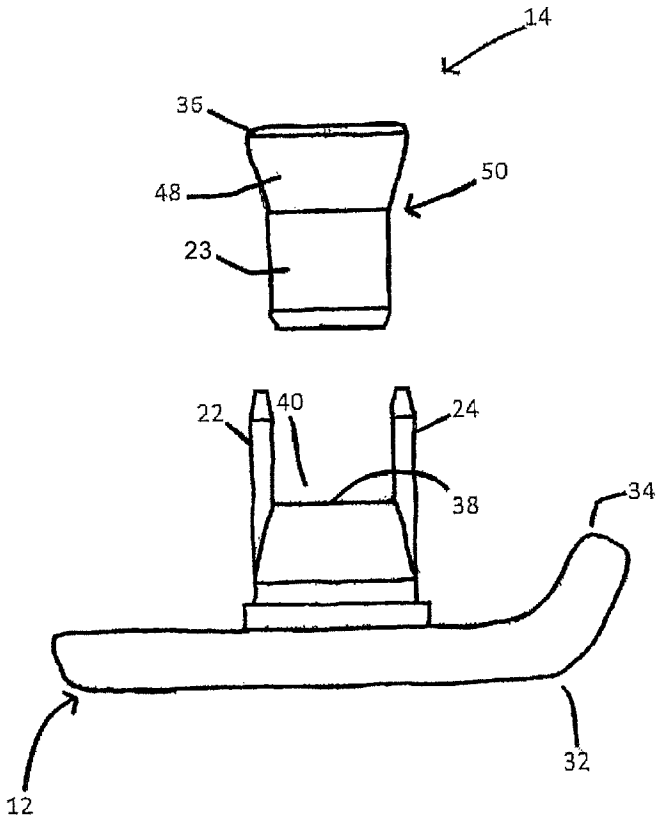
FIG. 3 is a side view of the base portion and the corresponding insert.
Figure 4:
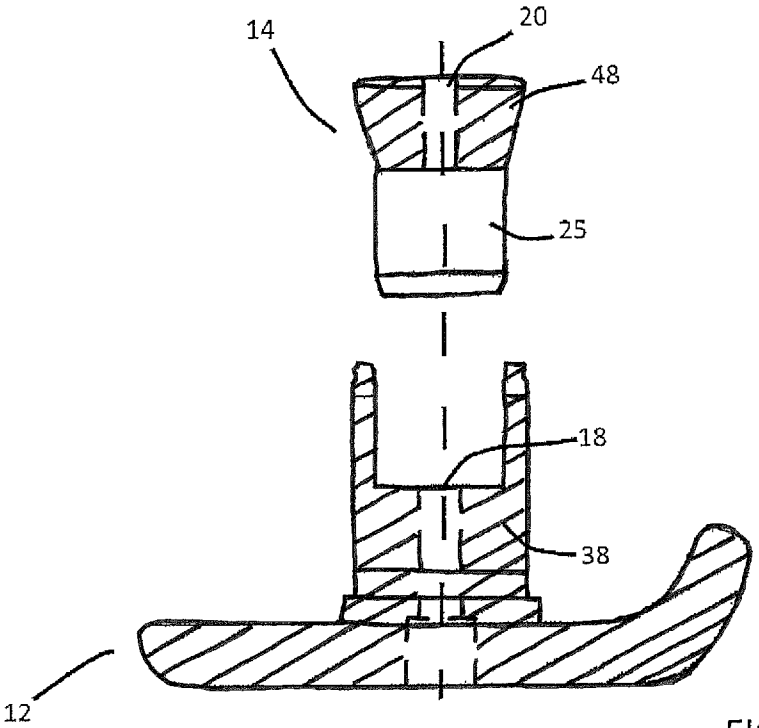
FIG. 4 is a cross section of the side view in FIG. 3.

In more detail as illustrated in FIGS. 2 and 3, the base 12 is substantially smooth on a bottom face 30, a surface engaging face, with a significant soft upward bend 32 of a forward edge 34 to aid in gliding movement. The base glider 10 must be sufficiently thick for durability over varying surface types such as wood, concrete, carpet, tile or grass and may be constructed of a durable plastic or other suitable synthetic polymer that is at least partially flexible. The base glider 10 is slightly wider than the walker leg in order to support the gliding movement of the walker. The aperture 18 is centered in the base 12 and adapted to engage the fastener.

Figure 5:
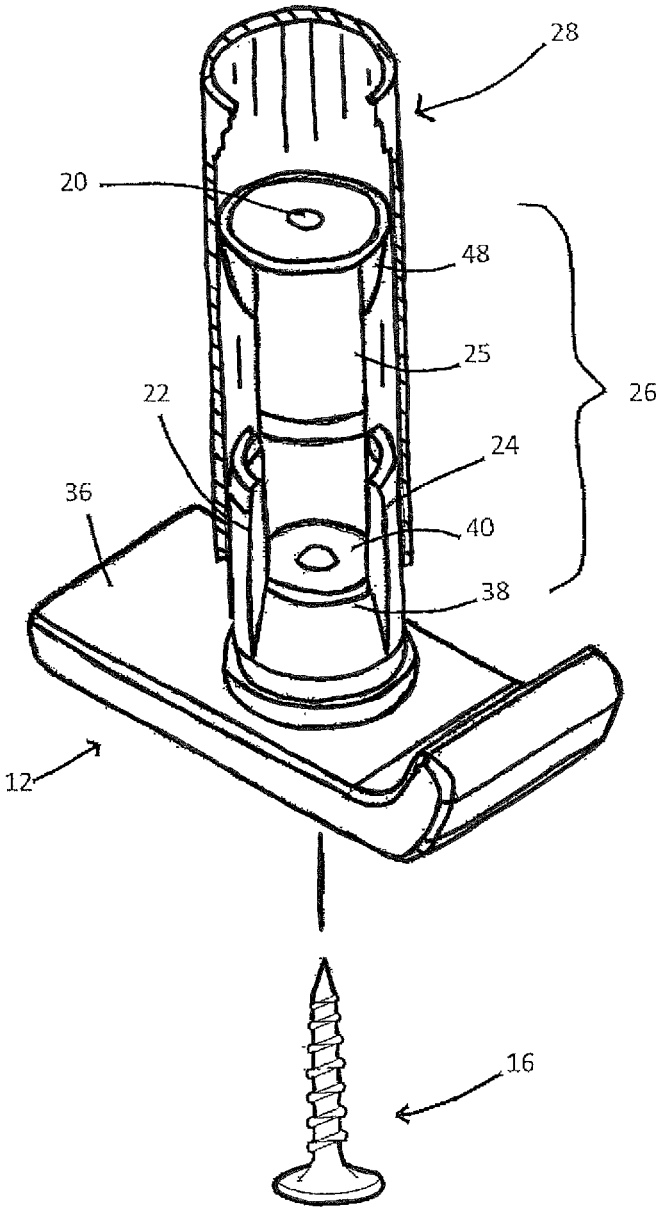
FIG. 5 is a perspective view of a glide pad for a walker as engaging with a walker leg.

As illustrated in FIGS. 1 and 5, extending upwardly from the top face 36 of the base 12 is a frustoconical member 38. The frustoconical member 38 is centrally located on the base 12. The aperture 18 is centered on and extends through the frustoconical member 38, having an opening in a truncated surface 40 of the frustoconical member 38. Two integrally formed arcuate stems 22 and 24 extend upwardly from the base of the frustoconical member 38. The stems 22 and 24 are spaced from each other on opposite sides of the frustoconical member 38. The stems 22 and 24 are of sufficient thickness to be flexed outwardly without losing structural integrity.

The top portion 14 comprises a substantially smooth disk 46. Extending downwardly from the bottom face of the disk 46 is a frustoconical member 48. An aperture 20 suitable for the fastener is centrally located in the disk 46, and extends through the frustoconical member 48 to an opening in a truncated surface 50 of the frustoconical member 48. Two integrally formed arcuate stems 23 and 25 extend downwardly from the base of the frustoconical member 48.

In one embodiment the base aperture 18 and the disk aperture 20 align to allow for connection of the base 12 to the top portion 14 by the fastener 16. The fastener 16 is inserted through aperture 18 to connect to aperture 20. Upon connection of the top portion 14 with the base 12, the top portion 14 rests above the base 12 at the point where tapered sides of the frustoconical member 48 contact the inner circumference of each arcuate stem 22 and 24. The stems 23 and 25 rest on contact with the frustoconical member 38. The stems 22 and 24 and the top portion 14 with stems 23 and 25 are positioned to form the insert 26. When positioned to form the insert, stems 22 and 24 are positioned opposite stems 23 and 25 so as to allow for sliding contact of the base 12 and the top portion 14. Insert 26 includes at least four stems, each extending outwardly in an opposing direction to the opposite stem of the pair of stems.

The insert 26 is inserted into the hollow walker leg 28. Upon fastening the fastener 16, the top portion 14 and the base 12 are slid into secure connection with each other. Fully engaging the fastener 16 allows sides of the frustoconical member 48 to contact stems 22 and 24 causing the stems 22 and 24 to flex outwardly; and also allows the sides of the frustoconical member 38 to contact stems 23 and 25 causing the stems 23 and 25 to flex outwardly. Thus stems 22 and 24 extend outwardly to frictionally engage the inside surface of the walker leg 28 while stems 23 and 25 extend outwardly to frictionally engage an additional portion of the inside surface of the walker leg. The truncated surfaces 40 and 50 allow for stability when the fastener is fastened or when the insert 26 is in the hollow leg 28. The surfaces 40 and 50 also prevent over tightening or over fastening of the fastener 16. The surfaces may prevent the stems 22, 23, 24 and 25 from extending or flexing outwardly too far or far enough to comprise the structural integrity of stems 22, 23, 24 and 25. The surfaces 40 and 50 increase support for stems 22 and 24 and 23 and 25 as well the insert 26 when frictionally engaged with the inside surface of the walker leg 28.

The stems 22 and 24 are able to frictionally engage the inside surface of the walker leg 28 as the frustoconical member 38 has a first, larger circumference at its proximal end and a second, smaller circumference at its distal end. The frustoconical member 38 has a base circumference substantially equal to the outside circumference of the arcuate stems 22 and 24 when not frictionally engaged with the inside surface of the walker leg 28 or when the fastener 16 is not engaged through both apertures 18 and 20. The arcuate nature of the stems 22 and 24 is co-extensive with the partial circumference of the base of the frustoconical member 38. The length of the frustoconical member 48 is sufficient to cause outward flexing or displacement of the stems 22 and 24 when making contact with the inside arcuate surfaces of stems 22 and 24. The outer surface of member 48 slides into contact with the inner surface of stem 22 or 24 while simultaneously displacing or flexing stem 22 and 24 outwardly into frictional engagement with the inside surface of the walker leg 28. In one embodiment, the stems 23 and 25 interact with frustoconical member 48 in substantially the same manner. Stems 23 and 25 are positioned relative to the frustoconical member 48 in substantially the same way as stems 22 and 24 are positioned relative to frustoconical member 38 as described above.

As the fastener 16 is fastened, the top portion 14 is secured to the base 12 and the glider 10, via the insert 26, is secured to the inside of the hollow walker leg 28. Upon loosening or removing the fastener 16, the stems 22 and 24 become disengaged with the inside surface of the walker leg, which allows the insert 26 or the glide pad 10 to be removable by the user.

Although the present invention has been described with reference to preferred embodiments, workers skilled in the art will recognize that changes may be made in form and detail without departing from the spirit and scope of the invention.

What is claimed is:

1. An attachment for a walker leg, the walker leg having a hollow lower portion, the attachment comprising:

a ground engaging base;

a first pair of stem portions spaced from each other and extending from and being attached to the base, the stems continuously spaced apart along their entire length;

a top portion comprising a first frustoconical main body to engage the first pair of stems of the base and the top portion having a shape so that an outer surface of the main body engages an inner surface of each stem of the first pair of stems so the outer surface of the stems engages the inner surface of the hollow lower portion of the leg;

a second pair of stem portions spaced from each other and extending from and being attached to the top portion; and a mechanism for drawing the main body in between the first pair of stem portions to flex the first pair of stems outwardly.

2. The attachment of claim 1 such that the ground engaging base and the top portion are positionable to form an insert to fit in the hollow lower portion of the walker leg.

3. The attachment of claim 2 wherein when the insert is fit into the hollow lower portion of the leg and the mechanism is engaged, the first pair of stem portions contact the main body and the stem portions flex outwardly to engage an interior surface of the hollow portion thereby securing attachment attaching to the walker leg.

4. The attachment of claim 1 wherein a second frustoconical member protrudes from a top surface of the base.

5. The attachment of claim 1 wherein the insert is cylindrical.

6. The attachment of claim 1 wherein the mechanism comprises a fastener.

7. The attachment of claim 1 wherein the second pair of stem portions are continuously spaced from each other along their entire length.

8. A method of securing an attachment to a walker leg, the walker leg having a hollow lower portion, the method comprising:

connecting a first pair of opposing stem portions spaced from each other and extending from a ground engaging base with a second pair of opposing stem portions spaced from each other and extending from a top portion to form an insert wherein each stem of the first pair are adjacent to each stem of the second pair;

placing the insert into the hollow lower portion of the walker leg;

inserting a fastener through an aperture in the ground engaging base and extending the fastener into an aperture in the top portion to thereby hold the insert in connection; and fastening the fastener to thereby engage the top portion with the first pair of stem portions and to thereby engage the base with the second pair of stem portions causing the pairs of stems to extend outwardly to engage with an inner surface of the hollow walker leg.

9. The method of claim 8 wherein securing the insert in the walker leg comprises fastening the fastener to bring a truncated surface of the base into contact with a truncated surface of the top portion.

* * * * *